US006782113B1

(12) United States Patent
Handsaker

(10) Patent No.: US 6,782,113 B1
(45) Date of Patent: Aug. 24, 2004

(54) SOUND DEVICE MOUNTING ASSEMBLY

(75) Inventor: Jerrold L. Handsaker, Roland, IA (US)

(73) Assignee: Innovative Lighting, Inc., Algona, IA (US)

( * ) Notice: Subject to any disclaimer, the term of this patent is extended or adjusted under 35 U.S.C. 154(b) by 106 days.

(21) Appl. No.: 10/141,237

(22) Filed: May 8, 2002

(51) Int. Cl.[7] ..... H04R 1/02

(52) U.S. Cl. ..... 381/386; 381/86; 381/302; 381/305; 381/189; 181/150; 181/153

(58) Field of Search ..... 381/86, 302, 303, 381/304, 305, 189; 181/148, 150, 153, 198, 199, 149; 340/984, 384.4, 384.6

(56) References Cited

U.S. PATENT DOCUMENTS 4,825,800 A 5/1989 Kitchen
5,363,436 A * 11/1994 McMonagle et al. .. 379/355.01
5,703,335 A 12/1997 Deutsch
6,139,170 A 10/2000 Wiggerman

* cited by examiner

*Primary Examiner*—Curtis Kuntz
*Assistant Examiner*—Brian Ensey
(74) *Attorney, Agent, or Firm*—McKee, Voorhees & Sease, P.L.C.

(57) ABSTRACT

The present invention includes a sound producing device assembly adapted for mounting a sound producing device assembly within a cavity. The sound producing device assembly is adapted for mounting within a cavity, such as a cavity within a boat. The assembly includes a sound producing device, a tubular member operatively connected to the sound producing device, and a flange operatively connected to the tubular member such that the flange connects to a surface.

29 Claims, 11 Drawing Sheets

SOUND DEVICE MOUNTING ASSEMBLY

BACKGROUND OF THE INVENTION

1. Field of the Invention

This invention relates to a sound producing device assembly. More specifically, although not exclusively, this invention relates to a water resistant piezohorn mounting assembly suitable for use in a boat.

2. Problems in the Art

Sound producing devices are commonly used as audio alerts or signaling devices. Sound producing devices such as whistles or trumpet horns, and other sound producing devices are particularly susceptible to malfunctioning in environments where water can cause damage to the sound producing device or where water can block air pathways, thus interfering with the production of sound.

Due to this susceptibility of sound devices to water intake and related environmental hazards, sound devices must be mounted in a location removed from water or other environmental hazards. These same problems can arise in various contexts.

Although, the present invention is not to be so limited, one particular application for the present invention relates to the use of a sound producing device in water vehicles such as boats. Boats are generally considered to be water born vehicles smaller than ships. Boats are equipped with various safety devices, some of which are required by authorities such as the Coast Guard. Equipment requirements vary with the size of the boat and its source of power. Safety requirements generally include such items as personal floatation devices, lights, and sound devices. Sound devices include sound signaling devices such as whistles, trumpet horns, sirens, or compressed air horns. The purpose of such a sound device is to signal the intentions of the operator of the boat. The use of the sound device provides an audio alert to others in the vicinity of the boat. In addition, a sound-producing device can be used to signal the position of the boat during periods of reduced visibility.

Although the advantages of having a sound producing device within the boat in order to comply with navigation rules and for distress signaling purposes is well recognized, a number of problems and limitations exist.

One problem with sound producing devices is the need for the sound-producing device to remain free from water intake. A general problem with sound producing devices used in boats is that the sound producing devices are susceptible to water intake and fail to function properly if water infiltrates the device. This is particularly true with trumpet horns and the like that simply cannot function properly when filled with water. If the horn is not functioning properly, it does not fulfill its needed purpose and is ineffective in signaling the intentions of the boat operator, thereby failing to increase safety.

To avoid or at least potentially reduce the risk of a sound producing device being affected by water intake, these sound producing devices have been mounted in positions on a boat to provide some additional protection. In particular, the sound producing devices are mounted away from the forward section of the boat in order to reduce the likelihood of intake of water. Some of these devices are mounted in the interior of the boat. These mounting locations of sound producing device produce new problems and limitations.

For example, when sound producing devices are mounted in the interior of a boat, the sound producing devices may have increased resistance to water intake, however, the effectiveness of the sound producing device is limited. Typically, the boat is moving in a forward direction under manual, motor, or other means of propulsion. When the boat is moving in a forward direction, it is most important that the sound producing device produce sounds in a forward direction beyond the front of the boat as it is the boat's movement that is likely to create the greatest dangers.

It is further recognized that mounting a sound producing device in the front of the boat may be undesirable. For example, it may distract from the aesthetic qualities of the boat or may get in the way of passengers of the boat. In addition, even if the sound producing device is mounted in the front of the boat, it may still be susceptible to water intake.

It is therefore a primary object of the present invention to provide an apparatus that improves upon the state of the art.

It is another object of the present invention to provide a sound producing device assembly that is substantially unaffected by water intake.

Yet another object of the present invention is to provide a sound producing device assembly that protects the sound producing device from the environment.

A further object of the present invention is to provide a sound producing device assembly that is easily mountable onto a surface of a boat.

Yet another object of the present invention is to provide a sound producing device assembly that can divert water flow.

Yet another object of the present invention is to provide a sound producing device assembly that is self-draining.

It is another object of the present invention to provide a sound producing device assembly that is mountable in the forward portion of a boat.

Yet another object of the present invention is to provide a sound producing device assembly for a boat that directs an audio alert in the forward direction of the boat.

Yet another object of the present invention is to provide a sound producing device assembly for a boat that produces a sound that can be clearly heard by those positioned in the forward direction of the boat.

A still further object of the present invention is to provide a sound producing device assembly for a boat that allows a sound producing device to be mounted on the side or top of a boat.

Yet another object of the present invention is to provide a sound producing device assembly for use in a boat in a manner that promotes safety.

A further object of the present invention is to provide a sound producing device assembly for a boat that is both easy to manufacture and install.

These and other objects, features and/or advantages of the present invention will become apparent from the specification and claims.

SUMMARY OF THE INVENTION

The present invention is a sound device mounting assembly. The sound device mounting assembly is adapted for mounting a sound device, such as a piezohorn, within a cavity. The sound device assembly includes a housing, the sound device disposed within a housing, a protective cover connected to the housing for protecting the sound device while still allowing the sound device to be heard, and a mounting flange operatively attached to the protective cover for securing the sound device assembly to a surface such that the sound device is disposed within the cavity. The sound device assembly of the present invention can protect a sound device from environmental hazards, such as water intake. Preferably, the sound device is a piezohorn, but the present invention contemplates that other types of sound devices can be used.

The protective cover of the sound device assembly can have a plurality of slats at least partially covering the housing for deflecting water without substantially affecting the sound of the piezohorn. This further guards against any water intake into the piezohorn while still allowing the horn to be heard. In addition, the housing can include at least one weephole for draining excess water from the housing, providing further protection against water intake.

The sound device assembly of the present invention can be inserted into a cavity, with the mounting flange of the device being attached to a surface. One example of such a surface is the sidewall or top of a boat. The sound producing device assembly of the present invention can be mounted within a circular opening of the cavity, the circular opening being created through drilling. This simplifies the installation procedure.

In addition, according to the present invention, a tubular member between the protective cover and the mounting flange. The tubular member can be cut at a diagonal relative to a longitudinal axis so as to define an elongated leading edge. The tubular member can be of various geometric shapes, including rectangular or cylindrical. This arrangement allows the piezohorn assembly to be mounted on a sidewall of a boat while still providing for sound to be directed in a forward direction parallel to the direction of travel of the boat.

DETAILED DESCRIPTION OF THE INVENTION

Figure 1:
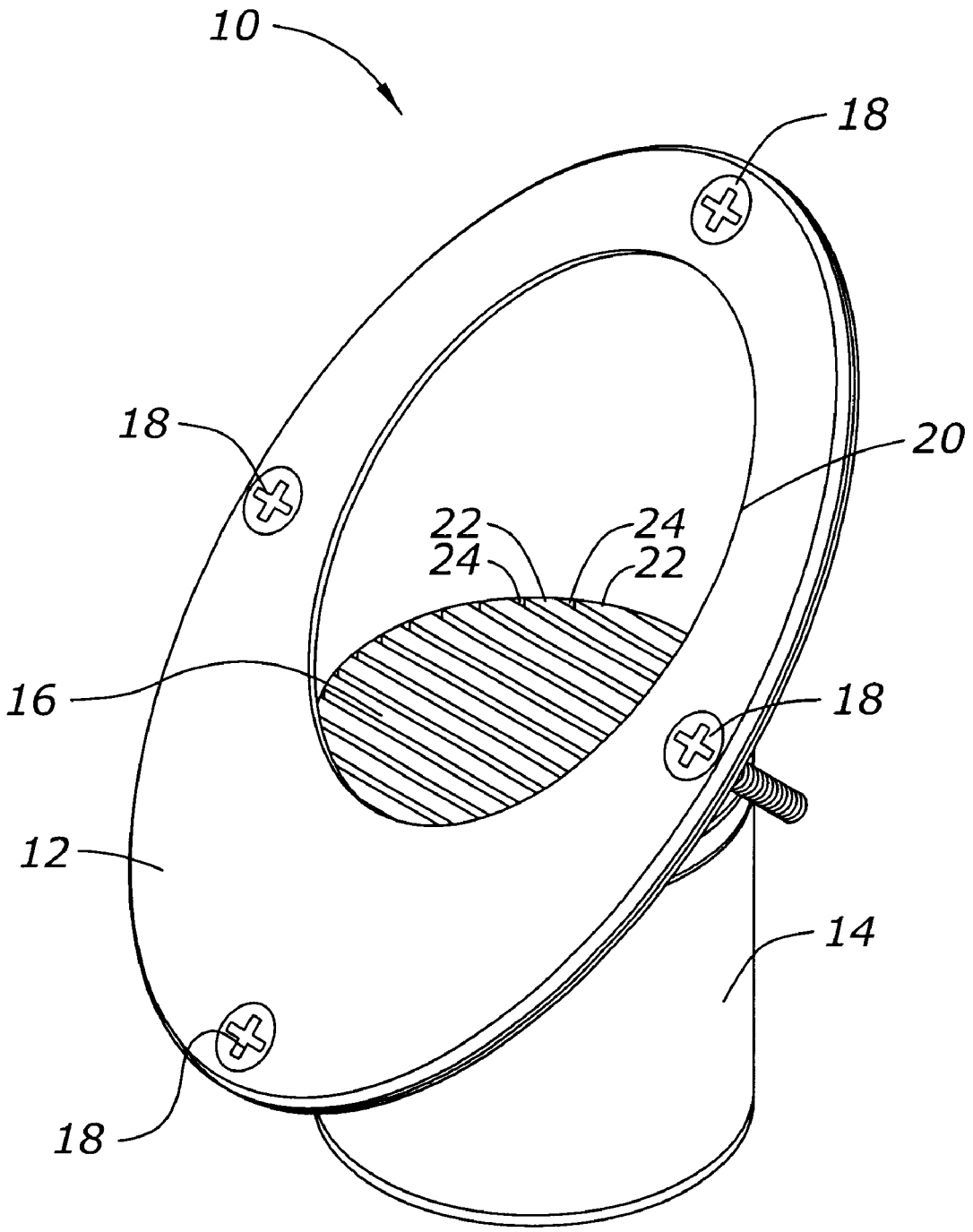
FIG. 1 is a side perspective view of the sound device assembly of the present invention.
Figure 2:
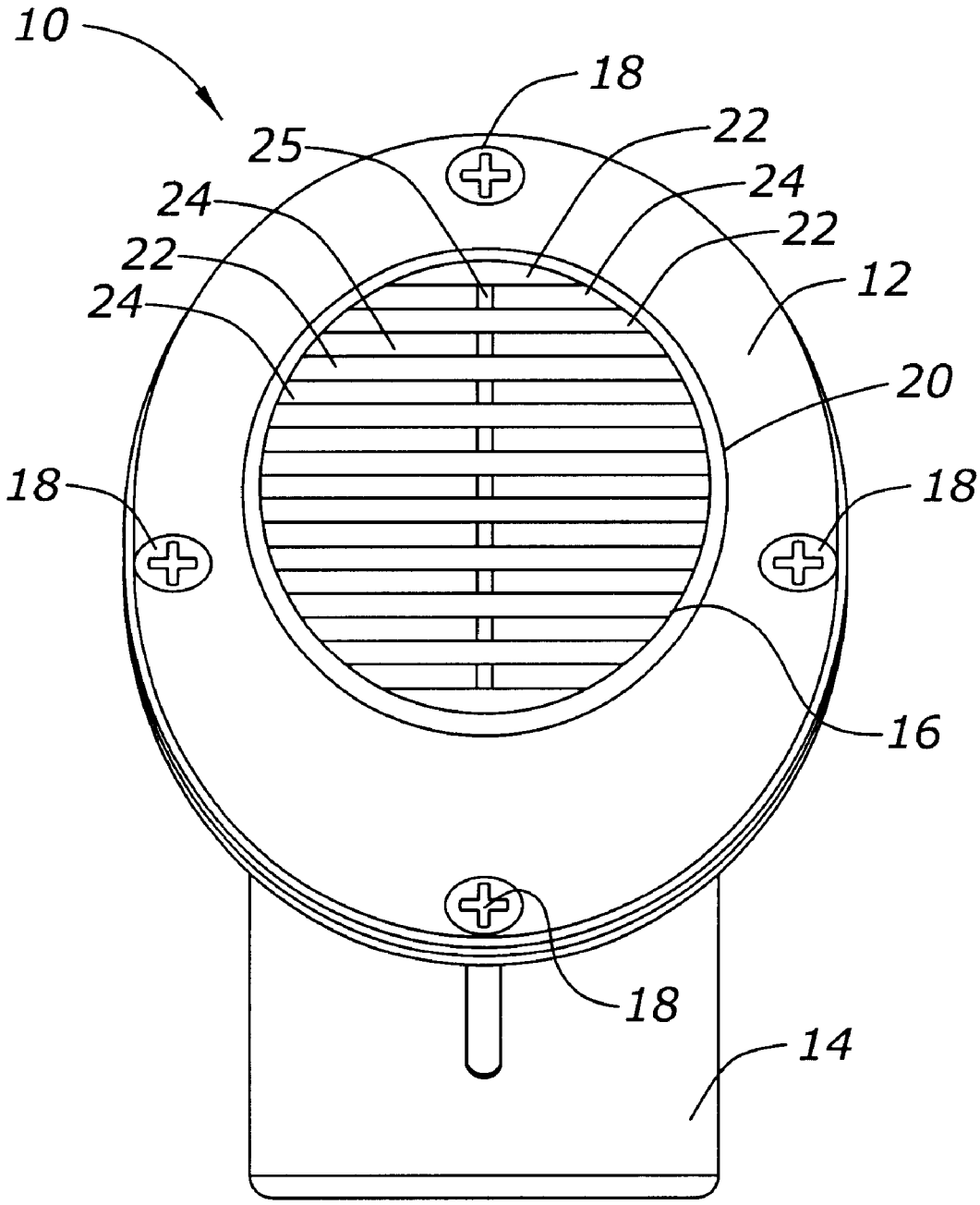
FIG. 2 is an elevated front perspective view of the sound device assembly of the present invention.
Figure 3:
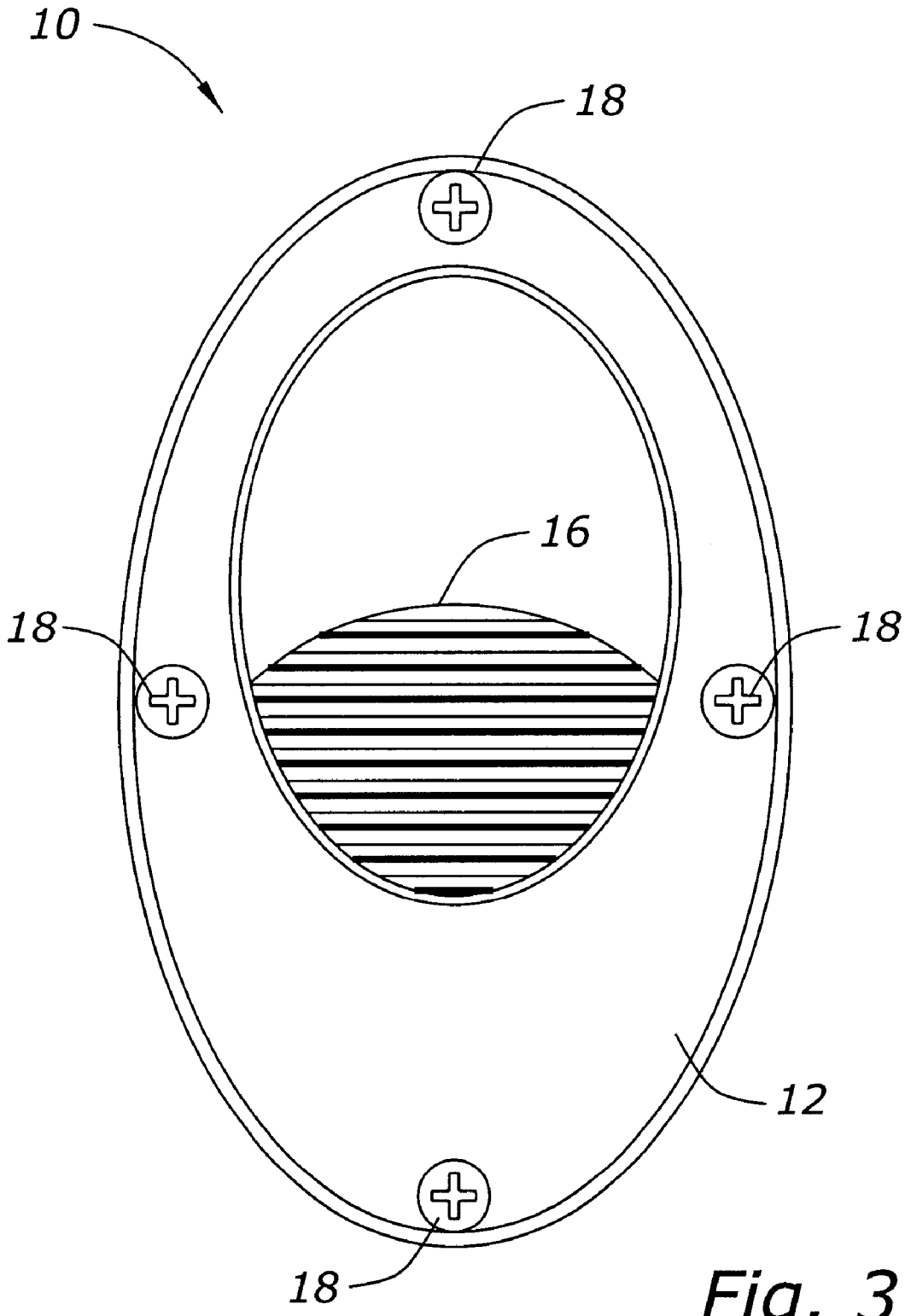
FIG. 3 is a front view of the sound device assembly of the present invention.
Figure 4:
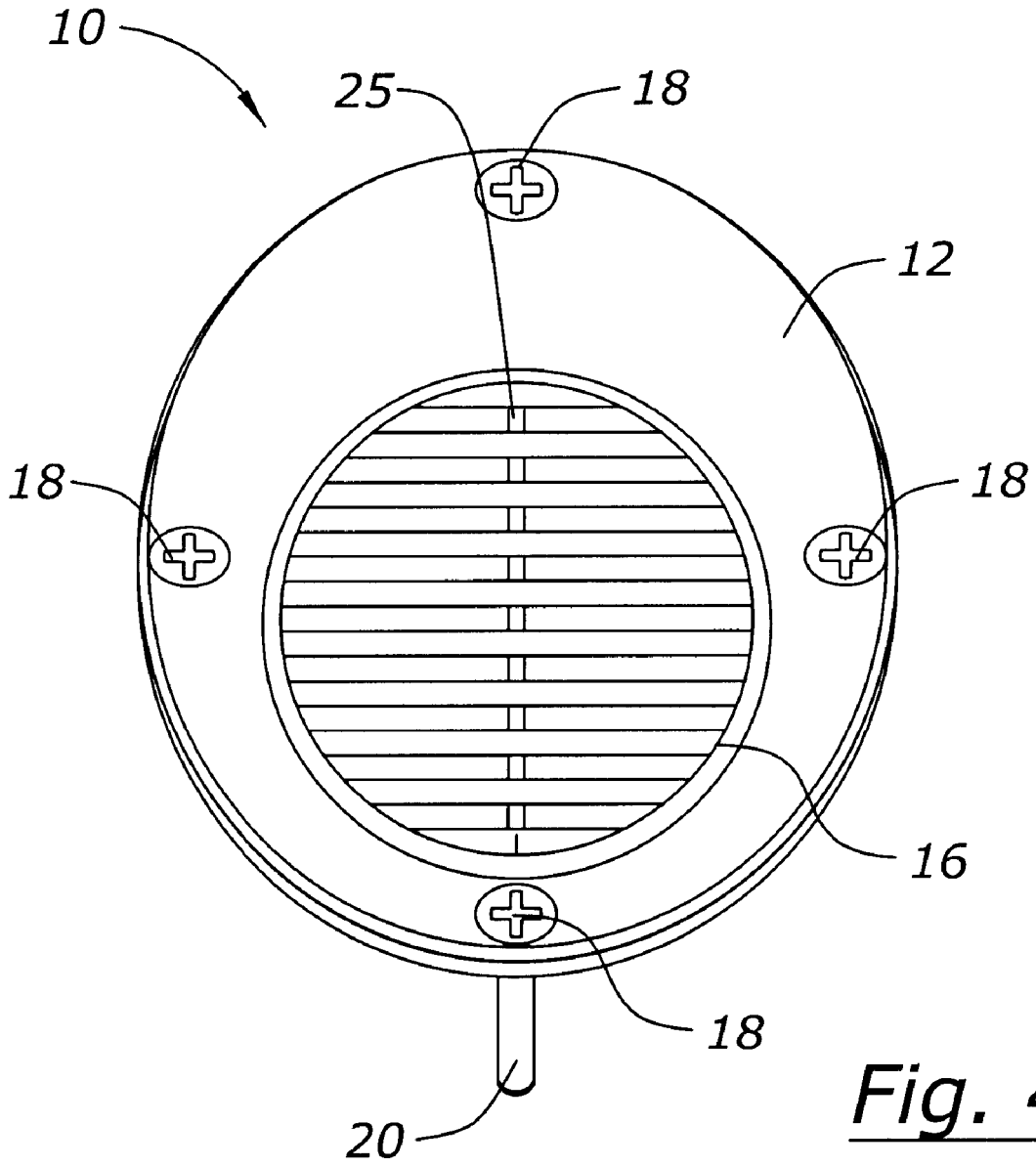
FIG. 4 is another front view of the sound device assembly of the present invention.

For a better understanding of the invention, an exemplary embodiment will now be described in detail. Frequent reference will be taken to the drawings. Reference numerals will be used in the drawings to indicate certain parts and locations in the drawings. The same reference numerals will indicate the same parts or locations throughout the drawings unless otherwise indicated.

FIGS. 1 through 4 show a sound device assembly 10 according to the present invention. In FIG. 1, the sound device assembly 10 includes a mounting flange 12 and housing 14. The housing 14 houses a piezohorn or other sound producing device. The present invention contemplates that the housing 14 need not be used. A protective cover or shield 16 is attached to the housing 14 in order to shield the sound producing device from environmental hazards such as water intake. The protective shield or cover 16 includes a plurality of openings 24. In addition, the protective shield or cover 16 includes a plurality of slats 22. The slats 22 can be connected with connecting member 25. The combination of the slats 22 and openings 24 protect the sound producing device within the housing 14 from water intake. The slats 22 can deflect water while still allowing sound waves from the sound producing device to pass through the protective cover 16.

The mounting flange 12 has an aperture 20 that may be elliptical. In addition, the flange 12 can include a plurality of apertures to accept fasteners 18 such as screws or bolts. The fasteners 18 are used to attach the assembly 10 to a surface with the cavity.

The present invention contemplates various modes of constructions and is not to be limited to any particular construction. For example, the present invention contemplates that the flange 12, tube 34 and shield 16 can be a single piece or multiple pieces.

Figure 5A:
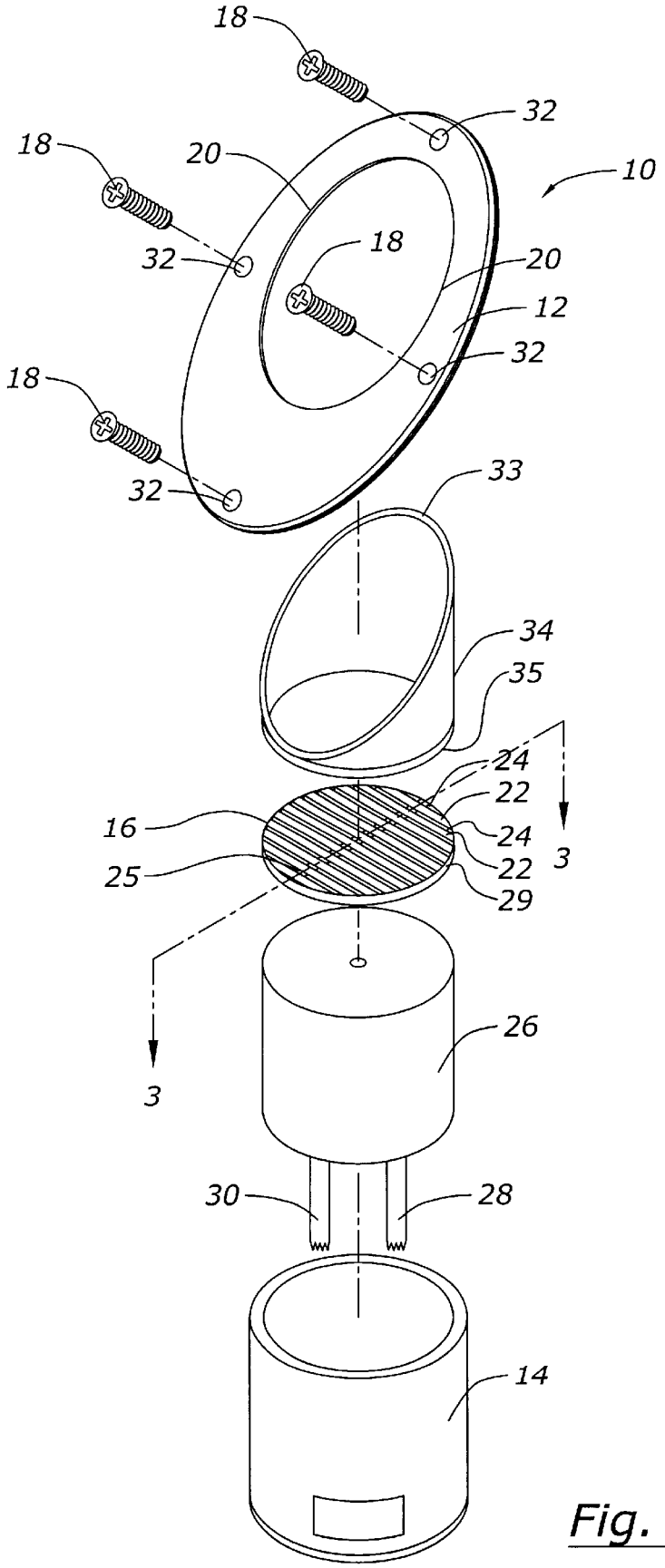
FIG. 5A is an exploded perspective view of one embodiment of the sound device assembly of the present invention.

FIG. 5A presents an exploded view of one embodiment of the sound producing device assembly 10 of the present invention. In FIG. 5A, a piezohorn 26 or other sound producing device is placed in the housing 14. The piezohorn 26 includes electrical connections 28 and 30 for energizing the piezohorn. The present invention contemplates that the piezohorn 26 may be mounted within the optional housing 14 through the use of fasteners or adhesives or other means. Similarly, the protective cover or shield 16 may be mounted to the piezohorn 26 or the housing 14 such as through use of an adhesive or can be snap fit or otherwise fastened. A tubular member 34 is used to separate the housing 14 from the flange 12. The tubular member 34 is cut at a diagonal relative to a longitudinal axis so as to define an elongated leading edge 33. The leading edge 33 can be elliptical in shape. The leading edge 33 is attached to the mounting flange 12 while the opposite edge 35 is operatively connected to the protective cover 16. Although the tubular member 34 shown is cylindrical in nature, the present invention contemplates that the tubular member 34 can also be rectangular or of other shape configuration.

In the embodiment shown, the leading edge 33 is elliptical in nature while the other edge 35 is circular. This configuration of the tubular member 34 is particularly well adapted for mounting in a front sidewall of a boat.

Figure 5B:
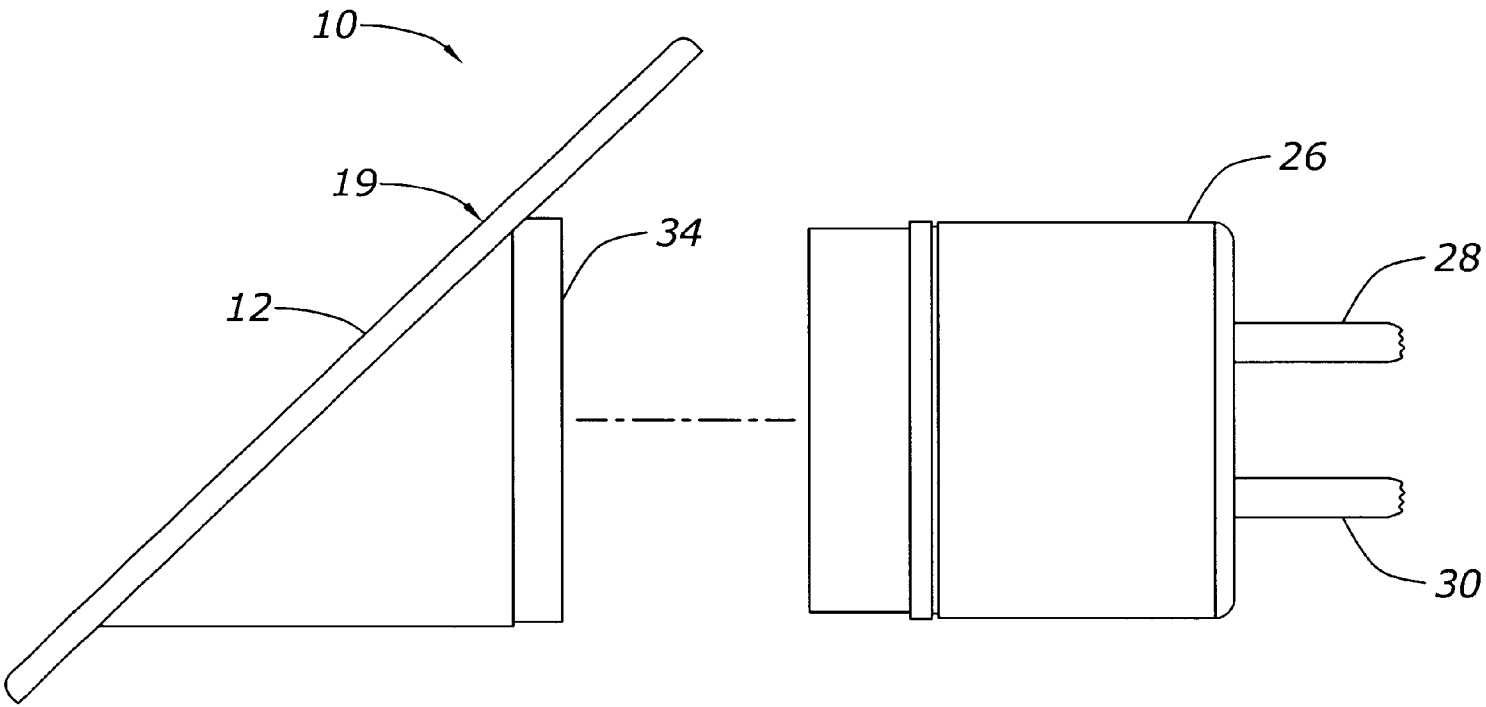
FIG. 5B is an exploded perspective view of another embodiment of the sound device assembly of the present invention.

FIG. 5B shows an exploded view of a second embodiment of the sound producing device assembly 10 of the present invention. FIG. 5B shows a one piece assembly 19 that includes the flange 12, tube 34, and shield 16. The one piece molded construction as shown is preferred. Also shown in FIG. 5B is a sound producing device 26 such as a piezohorn. In FIG. 5B, the piezohorn 26 is directly attached to the one piece assembly 19 and no housing is required. This reduces the number of parts and costs of manufacture.

Figure 6:
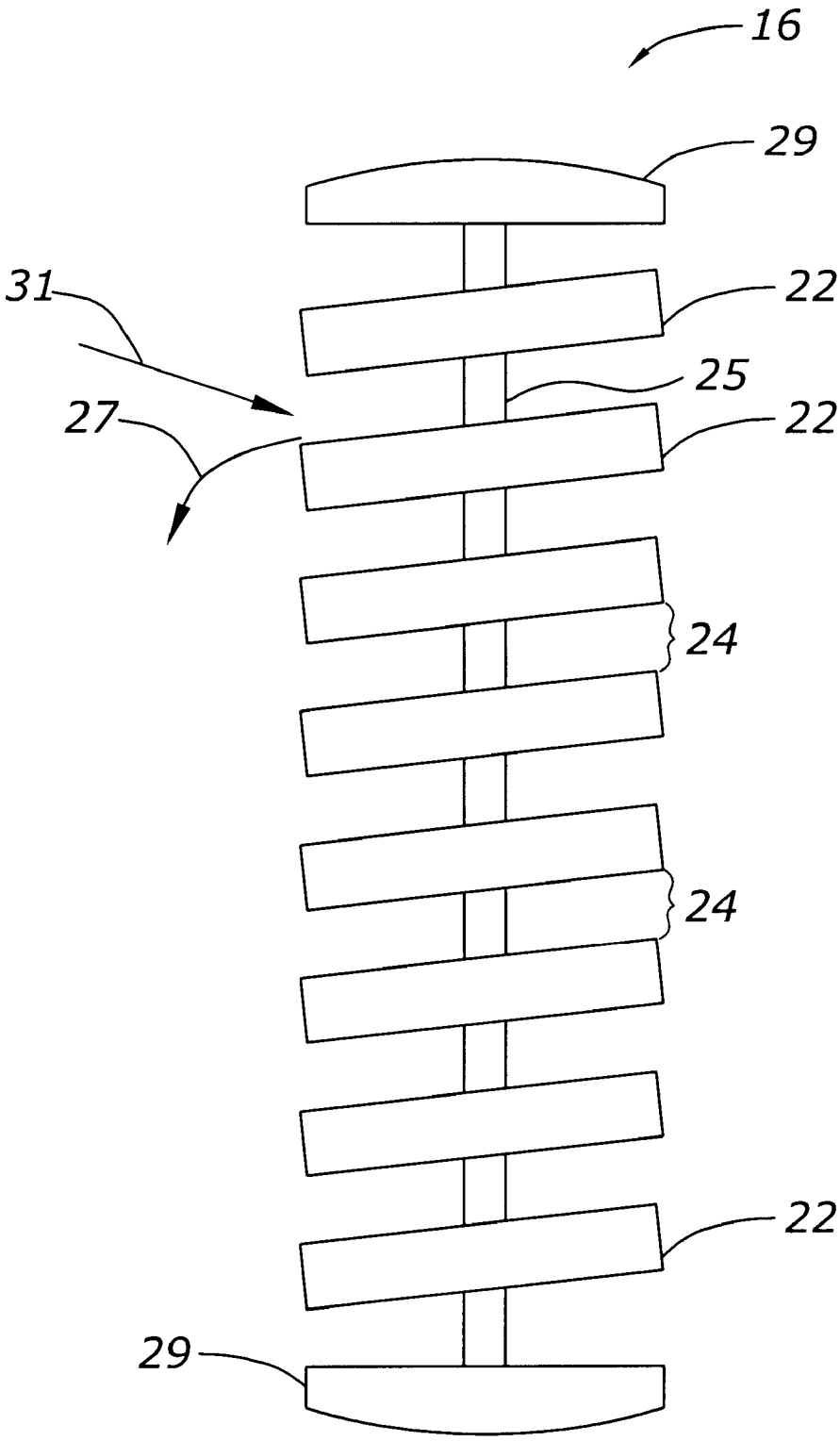
FIG. 6 is a cross-sectional view of a protective cover taken along line 3—3 of FIG. 5.

FIG. 6 provides a cross-sectional view of the protective cover 16 taken along line 3—3 of FIG. 5A. In FIG. 6, the slats 22 of the protective cover 16 are shown with spacings or openings 24 between the slats 22. The slats 22 are connected with a connecting member 25. In addition the protective cover 16 can include a frame member 29 such as a ring or other annular member. This configuration further protects the piezohorn from water intake. When water approaches the protective cover in the direction indicated by arrow. 31, the water is at least partially deflected by the slats 22 and drains off in the direction indicated by arrow 27.

Figure 7:
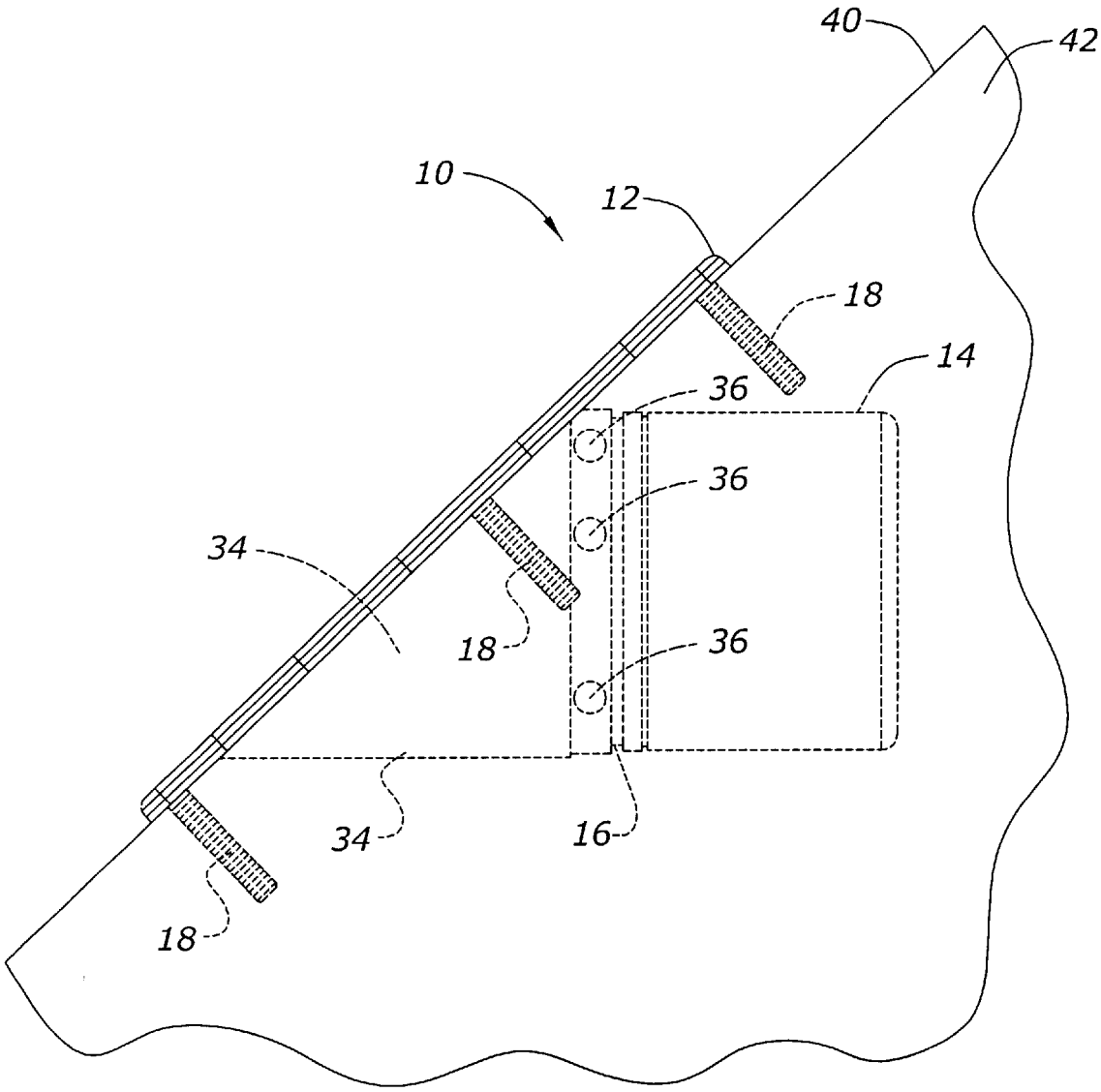
FIG. 7 is a side view of the sound device assembly of the present invention mounted against the surface of the cavity.

FIG. 7 illustrates the sound producing device assembly of the present invention mounted partially within a cavity 42, with the mounting flange 12 being attached to a surface 40 using the fasteners 18. As shown in FIG. 7, the tubular member 34 can optionally include one or more weepholes 36 for draining water. In addition, that portion of the sound producing device within the cavity 42 can be inserted through a cylindrical hole such as may be created through drilling.

Figure 8:
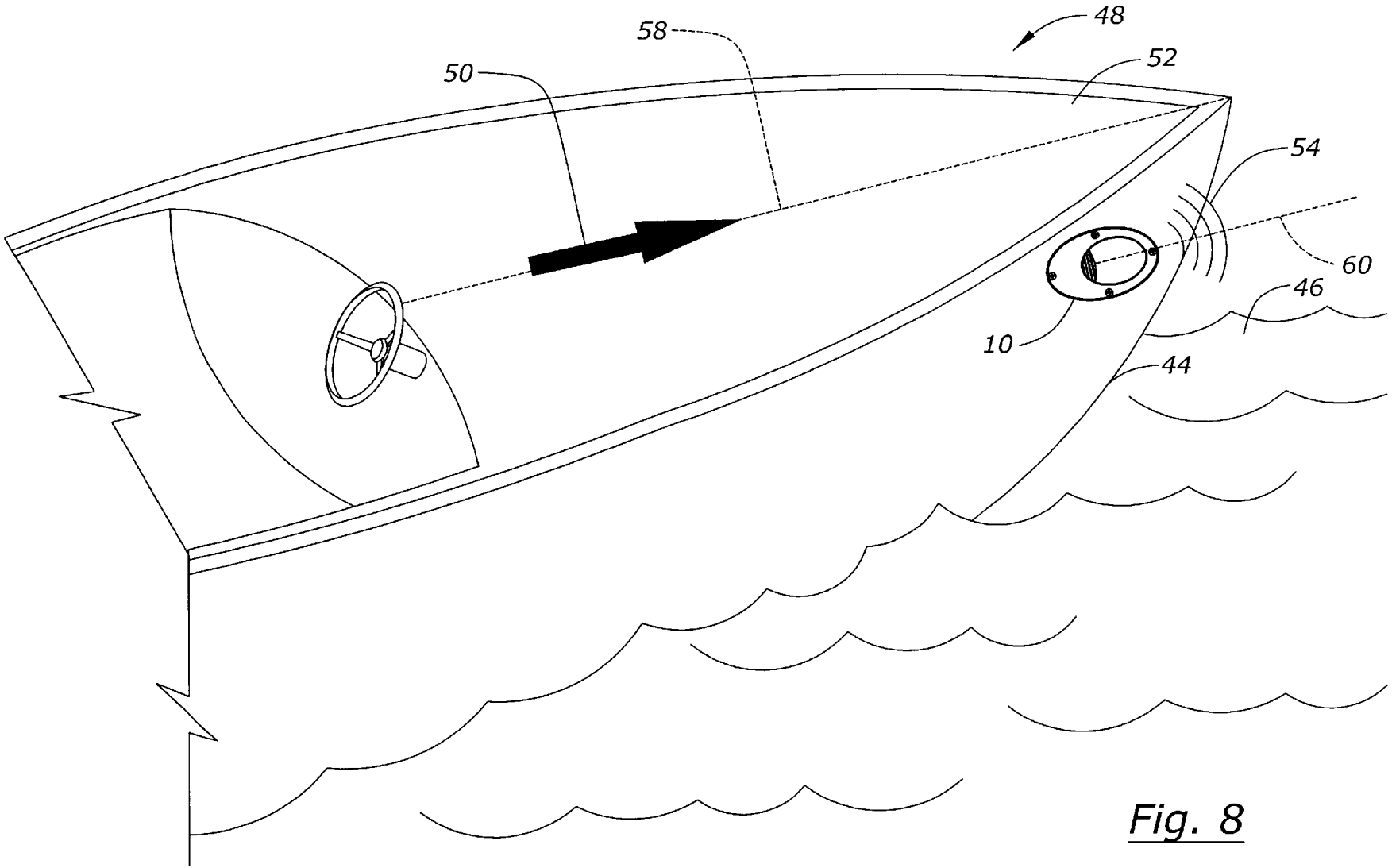
FIG. 8 is a pictorial representation of the sound device assembly of the present invention mounted in a boat.
Figure 9:
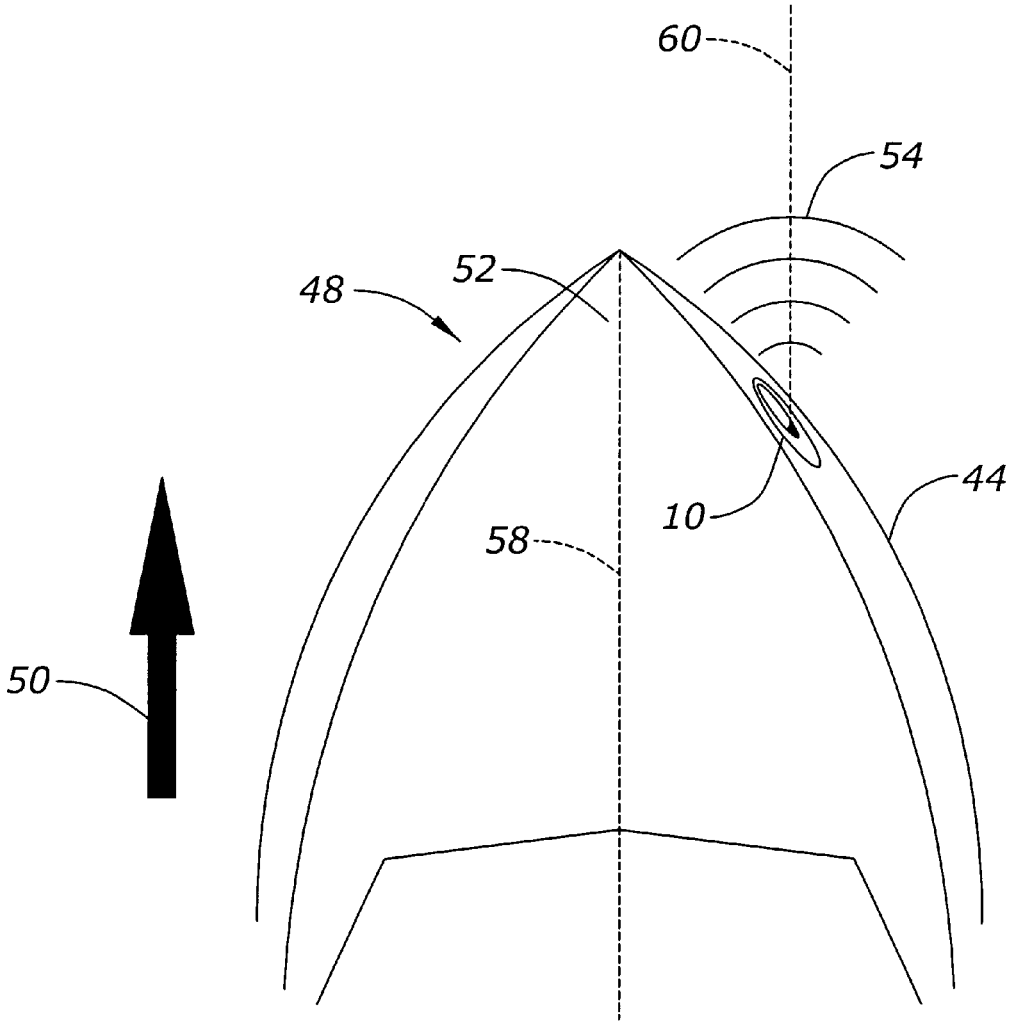
FIG. 9 is a top view of the sound device assembly of the present invention mounted on a sidewall of a boat.

FIGS. 8 and 9 show the sound producing device assembly of the present invention mounted in a boat having a bow and a stern and sidewalls connecting the bow and the stern. It is to be appreciated that the sound producing device assembly may be used in any number of applications, and is not to be limited to this particular environment. As shown in FIG. 8, the boat 48 moves in a forward direction indicated by the arrow 50. The forward direction is the direction that the boat generally travels when propelled by a motor, manually, or by other means. The boat 48 travels through the water 46. The water 46 can lap up against or otherwise come in contact with the sound producing device assembly 10. The sound producing device assembly 10 can produce an audio alert or audible sound that travels outward from the sound device assembly 10. In particular, the sound device assembly 10 produces an audible sound that propagates in a forward direction as well as in other directions. The sound waves 54 are indicated to show how the sounds generated from the sound producing device are propagated. It is to be understood that sound waves may propagate in other directions too, however, it is advantageous for the sound waves 54 to propagate in a forward direction consistent with the direction of travel indicated by the arrow 50, so that the sound producing device is useful for signaling intentions of the boat operator or signaling a position of the boat during periods of reduced visibility.

The sound producing device assembly 10 is mounted in a forward position of the boat 48, underneath the deck 52 of the boat and near the bow 44. As shown in FIG. 9, the sound waves 54 propagating from the sound producing device assembly 10 propagate in a forward direction. The sound waves 54 propagate in a substantial forward direction that need not be perpendicular to the angle of the sidewalls 44 of the boat due in part to the geometry of the tubular member 34.

Figure 10:
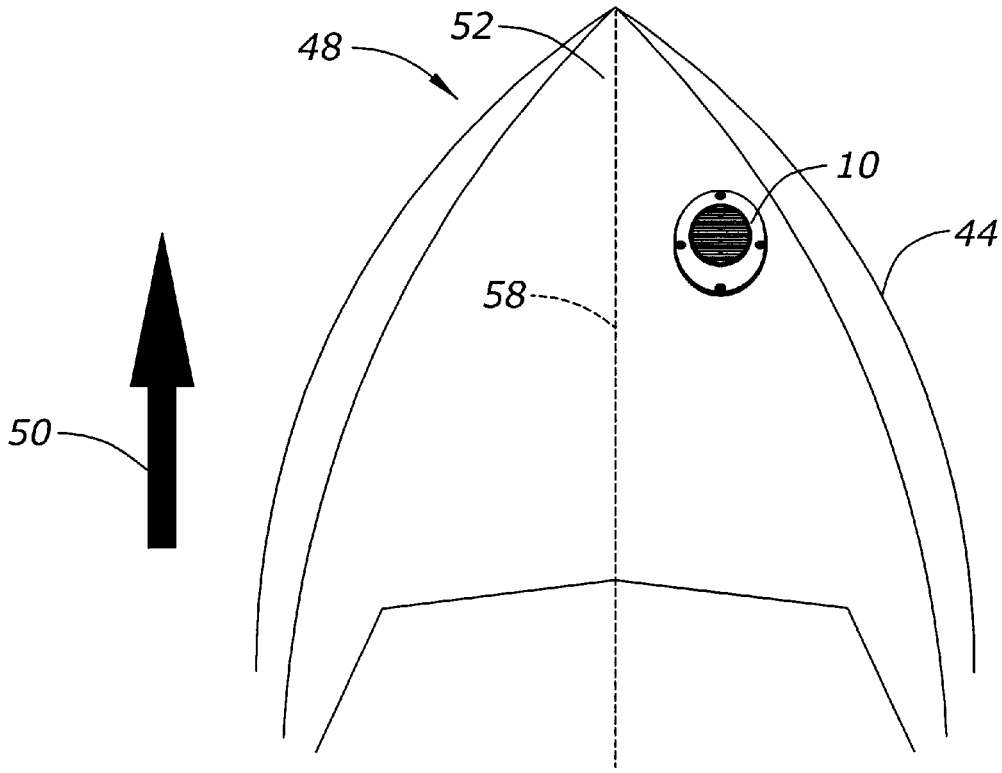
FIG. 10 is a top view of another embodiment of the present invention showing the sound device assembly mounted on a top wall of the boat.

FIG. 10 provides a top view of another embodiment of the present invention where the sound producing device 10 is mounted on the deck 52 or top of the boat in the forward position 48 of the boat.

Thus, the present invention provides for a number of advantages. The sound producing device assembly of the present invention can be easily mounted. Further, the sound producing device assembly of the present invention protects a sound producing device such as a piezohorn from environmental hazards such as water. At the same time, however, although water is deflected, sound waves emanating from the sound producing device are not blocked. The sound producing device assembly of the present invention is particularly well adapted for mounting on the front of a boat. This allows for sounds transduced to be directed in a direction forward of the boat. Because the sound producing device assembly of the present invention adequately protects a sound producing device such as a piezohorn from water intake, it can be mounted on the front of the boat and need not be on the deck of the boat. Further, sound producing device assembly of the present invention can be mounted by drilling a hole in a surface such as a boat sidewall which is both simple to do and low cost in nature.

Therefore, an apparatus, method, and system for an audio alert for a boat has been disclosed which solves problems and deficiencies in the art. From the foregoing, it will be observed that numerous variations and modifications may be affected without departing from the spirit and scope of the novel concepts of the present invention. It is understood that no limitation with respect to the specific embodiment illustrated herein is intended or should be inferred. The terms and expressions which have been employed herein are used as terms of description and a limitation. There is no intent in use of such terms and expressions to exclude any future equivalence of features shown and described herein, but it is recognized that various modifications are possible within the scope of the invention now claimed.

What is claimed is:

1. A sound producing device assembly for mounting to a boat, comprising:

a sound producing device;

a tubular member operatively connected to the sound producing device;

a flange operatively connected to the tubular member such that the flange connects to a surface of the boat and the sound producing device is disposed within a cavity of the boat such that sound from the sound producing device propagates through the tubular member;

a protective shield operatively connected to the sound producing device for protecting the sound producing device from water;

the flange and the protective shield situated in separate intersecting planes such that the sound producing device is suitable for mounting to a sidewall of the boat.

2. The sound producing device assembly of claim 1 wherein the sound producing device is a piezohorn.

3. The sound producing device assembly of claim 1 wherein the tubular member and the flange are of one piece construction.

4. The sound producing device assembly of claim 1 wherein the protective shield, tubular member, and flange are integrated into a single body.

5. The sound producing device assembly of claim 4 wherein the single body includes at least one weephole for draining water.

6. A piezohorn assembly adapted for mounting a piezohorn within a cavity, comprising:

a protective cover operatively connected to the piezohorn for protecting the piezohorn and having a plurality of openings for allowing an audible alert from the piezohorn to be emitted through the protective cover;

a tubular member cut at a diagonal relative to a longitudinal axis so as to define an elongated leading edge, the tubular member operatively connected to the protective cover; and a mounting flange operatively connected to the tubular member for securing the piezohorn assembly to a surface such that the piezohorn is disposed within the cavity;

the mounting flange and the protective cover situated in separate intersecting planes.

7. The piezohorn assembly of claim 6 wherein the protective cover includes a plurality of slats.

8. The piezohorn assembly of claim 6 wherein the mounting flange has an elliptical surface.

9. The piezohorn assembly of claim 6 wherein the mounting flange includes an elliptical aperture.

10. The piezohorn assembly of claim 9 wherein the elliptical aperture is positioned off-center on an elliptical surface of the mounting flange.

11. The piezohorn assembly of claim 6 wherein the mounting flange includes a plurality of apertures for accepting fasteners to secure the mounting flange to the surface.

12. The piezohorn assembly of claim 6 wherein the tubular member includes at least one weephole for draining excess water.

13. The piezohorn assembly of claim 6 wherein the surface is a sidewall of a boat.

14. A piezohorn assembly adapted for insertion into a cavity, comprising:

a piezohorn;

a housing, the piezohorn disposed within the housing;

a protective shield operatively connected to the housing for at least partially protecting the piezohorn from water;

a mounting flange operatively connected to the protective shield for securing to a surface;

the mounting flange and the protective shield situated in separate intersecting planes.

15. The piezohorn assembly of claim 14 wherein the protective shield includes a plurality of slats for deflecting water.

16. The piezohorn assembly of claim 14 wherein the surface is a surface of a water vehicle.

17. The piezohorn assembly of claim 14 wherein the cavity has a circular opening.

18. The piezohorn assembly of claim 14 further comprising a tubular member connecting the mounting flange and the protective shield.

19. The piezohorn assembly of claim 18 wherein the tubular member is cut at a diagonal relative to a longitudinal axis so as to define an elongated leading edge.

20. The piezohorn assembly of claim 19 wherein the elongated leading edge is elliptical in shape.

21. The piezohorn assembly of claim wherein 18 the tubular member includes a plurality of weepholes for draining excess water.

22. The piezohorn assembly of claim 18 wherein the tubular member is a cylindrical tube cut at a diagonal relative to a longitudinal axis.

23. A water vehicle having a bow and a stem, comprising:

a sidewall connecting the bow and the stem; and a piezohorn assembly mounted within a cavity of the sidewall and having a piezohorn disposed, a protective cover operatively connected to the piezohorn for protecting the piezohorn, a tubular member cut at a diagonal relative to a longitudinal axis so as to define an elongated leading edge, the tubular member operatively connected to the protective cover, and a mounting flange attached to the tubular member for securing the piezohorn assembly to the sidewall;

the mounting flange and the protective shield situated in separate intersecting planes.

24. A method of providing a sound producing assembly for a boat, comprising:

drilling a hole in a sidewall of a boat to provide access to a cavity;

providing a sound producing device assembly having a sound producing device operatively connected to a tubular member such that sound produced by the sound producing device is transmitted through the tubular member and a flange operatively connected to the tubular member, the sound producing device including a shield operatively connected between the tubular member and the sound producing device, the shield and the flange situated in separate intersecting planes;

placing the sound producing device assembly such that the sound producing device is within the cavity and the flange is outside of the cavity; and attaching the flange to the boat.

25. The method of claim 24 wherein the sound producing device is a piezohorn.

26. The method of claim wherein 24 the sound producing device is placed within a housing, the housing operatively connected to the piezohorn.

27. The method of claim 24 further comprising producing an audible sound with the sound producing device such that the sound is directed towards outward from the front portion of the boat.

28. A piezohorn assembly adapted for mounting a piezohorn within a cavity, comprising:

a protective cover operatively connected to the piezohorn for protecting the piezohorn and having a plurality of openings for allowing an audible alert from the piezohorn to be emitted through the protective cover;

a tubular member cut at a diagonal relative to a longitudinal axis so as to define an elongated leading edge, the tubular member operatively connected to the protective cover;

a mounting flange operatively connected to the tubular member for securing the piezohorn assembly to a surfacer such that the piezohorn is disposed within the cavity;

the mounting flange including an elliptical aperture; the elliptical aperture positioned off-center on an elliptical surface of the mounting flange.

29. A piezohorn assembly adapted for mounting a piezohorn within a cavity, comprising:

a protective cover operatively connected to the piezohorn for protecting the piezohorn and having a plurality of openings for allowing an audible alert from the piezohorn to be emitted through the protective cover;

a tubular member cut at a diagonal relative to a longitudinal axis to as to define an elongated leading edge, the tubular member operatively connected to the protective cover;

a mounting flange operatively connected to the tubular member for securing the piezohorn assembly to a surface such that the piezohorn is disposed within the cavity;

the mounting flange includes a plurality of apertures for accepting fasteners to secure the mounting flange to the surface.

* * * * *